US005455804A

United States Patent [19]

Holmes et al.

[11] Patent Number: 5,455,804

[45] Date of Patent: Oct. 3, 1995

[54] VORTEX CHAMBER MUD PULSER

[75] Inventors: Allen B. Holmes, Rockville; Frank B. Vanaman, Baltimore; Tadeusz M. Drzewiecki, Rockville, all of Md.

[73] Assignee: Defense Research Technologies, Inc., Rockville, Md.

[21] Appl. No.: 255,866

[22] Filed: Jun. 7, 1994

[51] Int. Cl.[6] ..... H04H 9/00

[52] U.S. Cl. ..... 367/83; 181/106; 137/812; 137/813

[58] Field of Search ..... 367/83; 181/106, 181/119; 137/804, 808, 812, 813

[56] References Cited

U.S. PATENT DOCUMENTS

| | | | |
|---|---|---|---|
| 3,432,804 | 3/1969 | Beeken | 367/83 |
| 3,860,902 | 1/1975 | Galle | 367/83 |
| 3,911,858 | 10/1975 | Goodwin | 367/83 |
| 3,958,217 | 5/1976 | Spinnler | 367/83 |
| 4,078,620 | 3/1978 | Westlake et al. | 367/83 |
| 4,134,100 | 1/1979 | Funke | 367/83 |
| 4,276,943 | 7/1981 | Holmes | 175/40 |
| 4,291,395 | 9/1981 | Holmes | 367/83 |
| 4,323,991 | 4/1982 | Holmes et al. | 367/83 |
| 4,391,299 | 7/1983 | Holmes | 367/171 |
| 4,418,721 | 12/1983 | Holmes | 137/810 |
| 4,557,295 | 12/1985 | Holmes | 137/813 |
| 4,862,837 | 9/1989 | Holmes | 123/23 |

*Primary Examiner*—J. Woodrow Eldred

[57] ABSTRACT

A vortex chamber fluid pulser selectively produces pressure pulses in fluid flowing therethrough by the alternating insertion and retraction of a flow-disrupting tab into and out of an annular vortex chamber having an inlet and a pair of opposed axial outlets. Insertion of the tab disrupts the normally radial flow of fluid through the chamber and outlets causing the flow to become vortical; retraction of the tab causes a second pressure pulse as the flow returns to radial, sending a sequence of pressure pulses capable of carrying encoded signals to a transducer remotely located in the fluid.

11 Claims, 6 Drawing Sheets

VORTEX CHAMBER MUD PULSER

BACKGROUND OF THE INVENTION

1. Field of the Invention:

The present invention relates to the transmission of data from the bottom of a bore hole to the surface and, more particularly, to a device for creating information-carrying pressure pulses in the circulating flow of fluid between a drill bit and the surface by selectively controlling the fluid flow patterns.

2. Discussion of the Prior Art:

For reasons of economy and safety it is highly desirable that the operator of a drill string be continually aware of such down-hole parameters as drill bit position, temperature and bore hole pressure. Knowledge of the drill bit position during drilling can save significant time and expense during directional drilling operations. For safety it is of interest to predict the approach of high pressure zones to allow the execution of proper preventive procedures in order to avoid blowouts. In addition, efficient operation of the drill string requires continuous monitoring of down-hole pressure. The pressure in the bore hole must be maintained high enough to keep the walls of the hole from collapsing on the drill string yet low enough to prevent fracturing of the formation around the bore hole. In addition the pressure at the bit must be sufficient to prevent the influx of gas or fluids when high pressure formations are entered by the drill bit. Failure to maintain proper down-hole pressure can and frequently does lead to loss of well control and blowouts.

Any system that provides measurements while drilling (MWD) must have three basic capabilities: (1) to measure the down-hole parameters of interest; (2) to telemeter the resulting data to a surface receiver; and (3) to receive and interpret the telemetered data. Of these three essential capabilities, the ability to telemeter data to the surface rapidly is the current limiting factor in developing MWD systems.

Four general methods have been studied that would provide transmission of precise data from one end of the well bore to the other: mud pressure pulse, hard wire, electromagnetic waves, and acoustic methods. At this time, mud pulsing has proven to be the most practical method.

In a typical mud pulsing system pressure pulses are produced by a mechanical valve located in a collar above the drill bit. The pulses represent coded information from down-hole instrumentation. The pulses are transmitted through the mud to pressure transducers at the surface, decoded and displayed as data representing pressure, temperature, etc. from the down-hole sensors. Of the four general methods named above, mud pulse sensing is considered to be the most practical as it is the simplest to implement and requires no modification of existing drill pipe or equipment.

Mechanical mud pulsers, known in the art, are inherently slow, producing only one to five pulses per second, are subject to frequent mechanical breakdown, and are relatively expensive to manufacture and maintain. An example of such a device is disclosed in U.S. Pat. No. 3,958,217 (Spinnler) disclosing a valve mechanism for producing mud pulses.

U.S. Pat. No. 4,418,721 (Holmes) discloses the use of a fluidic valve to rapidly change the flow of mud from radial to vortical and back again, altering the flow pattern of the fluid and producing pressure pulses therein. Mud flow through the valve transits a vortex chamber and diffuser assembly in a generally radial flow pattern, exiting the valve through an outlet located at the center of the chamber on one side of the assembly. A small tab is selectively extended from a recessed position into, and retracted from, the vortex chamber by a solenoid responding to encoded sequences of electrical impulses from measurements made by down-hole sensors. The insertion of the tab into the vortex chamber disturbs the fluid flow and transforms the radial flow to vortical, producing a pressure pulse that is radiated through the mud back up the drill pipe to the surface transducer. The activation energy for the tab is relatively low and the permissible pulse rate is therefore much higher than can be achieved with mechanical valves. Disadvantageously, such devices are characterized by relatively restrictive flow channel sizes requiring parallel connection of multiple valves with accompanying energy and volume requirement penalties and clogging potential. In addition, areas within the assymetrical vortex chamber suffer high pressure and wear, necessitating frequent inspection and maintenance and requiring costly reinforced construction.

OBJECTS AND SUMMARY OF THE INVENTION

The primary object of the present invention is to overcome the disadvantages of prior art mud pulsers by providing a vortex chamber mud pulser capable of producing a high signal rate and requiring very low activating energy.

It is a further object of the present invention to provide a durable and rugged mud pulser with an increased flow channel to minimize clogging.

Still another object of the present invention is to provide a mud pulser having a simple configuration and no pressure loaded moving parts.

Still another object of the present invention is to increase the flow rate through a mud pulser and increase the useful life by minimizing areas of high pressure and erosion.

Some advantages of the present invention over the prior art are that the mud pulser of the present invention: simplifies mud pulse telemetry by reducing the number of valves and the number and mass of actuator parts required to generate signal pulses; adds reliability and economy to mud pulse telemetry by providing a mud pulser with increased shock and vibration resistance and fewer areas of high wear and erosion; and is of simple and inexpensive construction.

In accordance with the present invention a flow disturbing tab extends from a recessed position into a vortex chamber and is withdrawn therefrom by an opposed pair of solenoids responding to signals received from a transducer or sensor. Drilling mud flows through an inlet in the top of the mud pulser valve module along the axis of the drill hole into an annular vortex chamber and exits through a pair of outlet nozzles axially aligned normal to the drill hole axis on opposite sides of the vortex chamber. The flow is radial through the symmetrical vortex chamber until the tab selectively disturbs the chamber symmetry and creates "free" vortex motion in the fluid flow. The swirling vortex path increases the tangential velocity of the fluid and reduces the static pressure driving the mud through the outlet nozzles. A rapid flow rate decrease results producing a positive pressure pulse each time the tab is inserted and a negative pulse each time the tab is withdrawn from vortex chamber flow. The sequencing and timing of the pressure pulses can be selectively controlled to encode and transmit binary data through the mud to a receiving sensor located in the flow pipe at the surface.

Other objects and advantages of the present invention will become apparent from the following description of the preferred embodiment taken in conjunction with the accompanying drawings wherein like parts in each of the several figures are identified by the same reference characters.

DESCRIPTION OF THE PREFERRED EMBODIMENT

Figure 1:
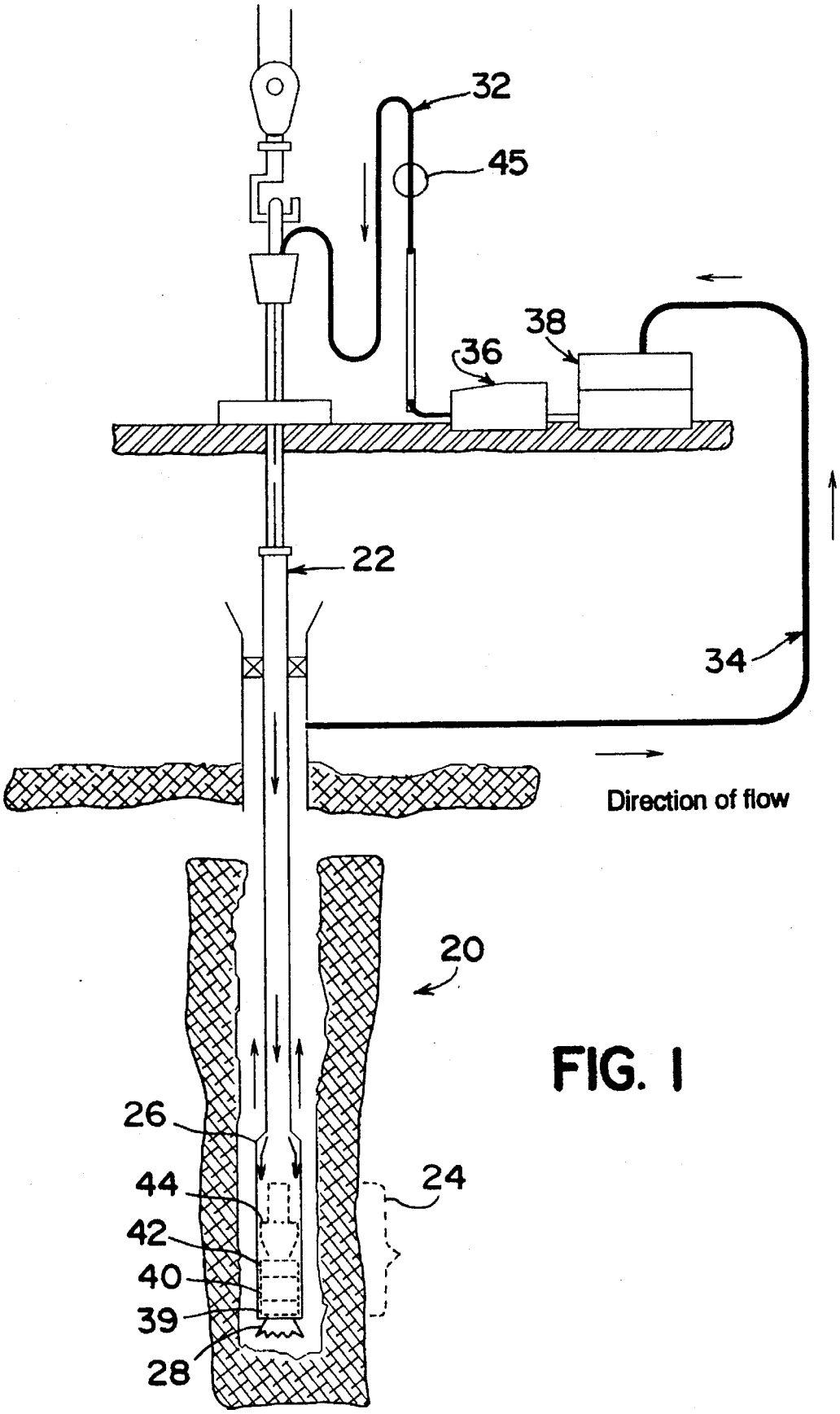
FIG. 1 is a schematic view of the vortex chamber mud pulser device of the present invention as an element of a drill string employing a circulating mud system.

A drill string 20 shown in FIG. 1 includes a drill pipe 22 supported and operated from above ground, a measurement while drilling (MWD) package 24 contained within an enlarged lower section 26 of the drill pipe and a drill bit 28. Drilling mud, a fluid used to remove cuttings and stabilize down-hole pressure, is circulated as shown by the arrows along the drill pipe 22, over and through the MWD package 24, through nozzles in the drill bit 28 and back along the annular space between the drill pipe and the bore hole. Feed and return lines 32 and 34, respectively, connect the drill pipe with a pump 36 and a mud pit 38 where cuttings are separated out of the fluid. The MWD package 24 contains instrumentation 39 to sense physical parameters around the drill head, a signal processing package 40 to convert sensor output to electrical impulses, a power supply 42 and a vortex chamber fluid pulser 44 to convert the electrical impulses into pressure waves, detected on the surface by a pressure transducer 45 in the wall of feed line 32.

Figure 2:
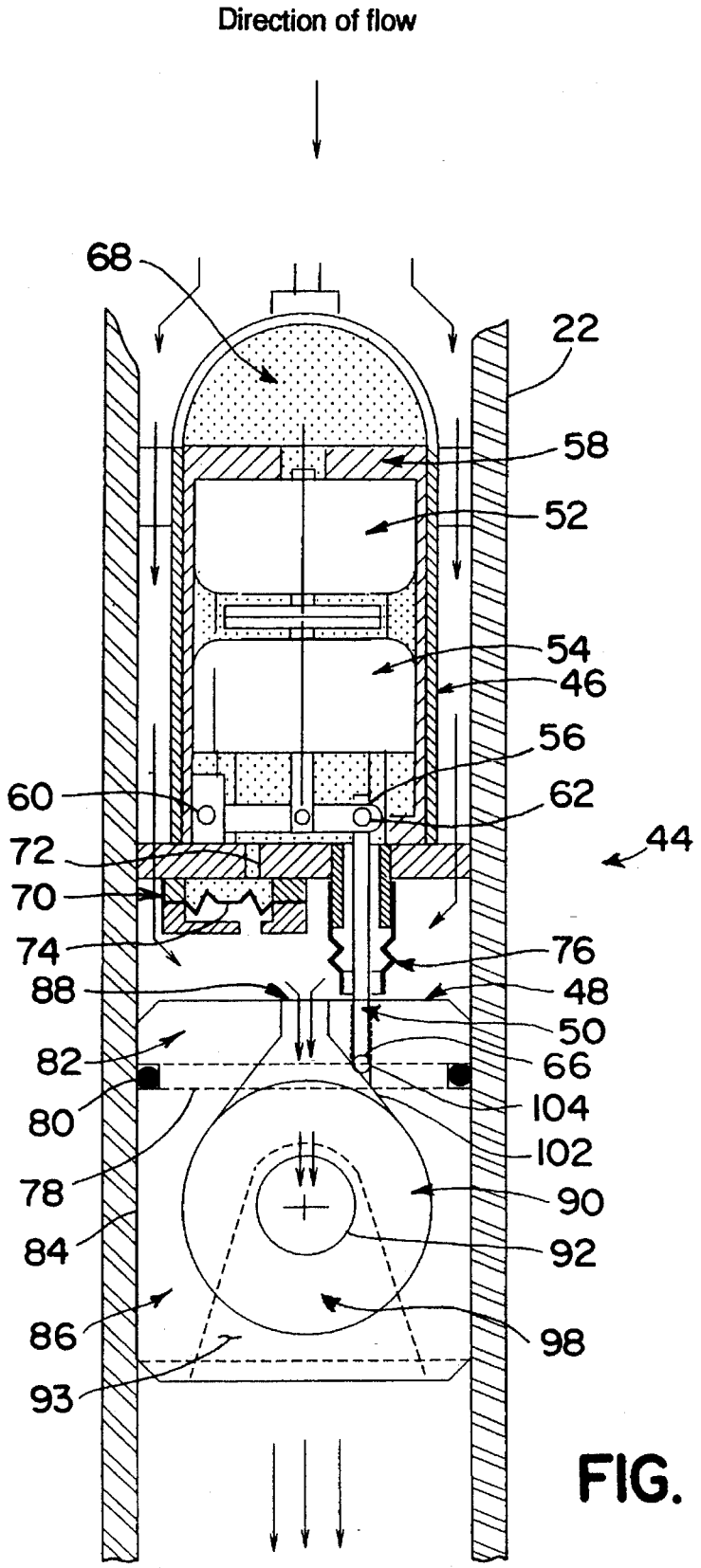
FIG. 2 is a front view in section of the vortex chamber mud pulser according to the present invention.
Figure 3:
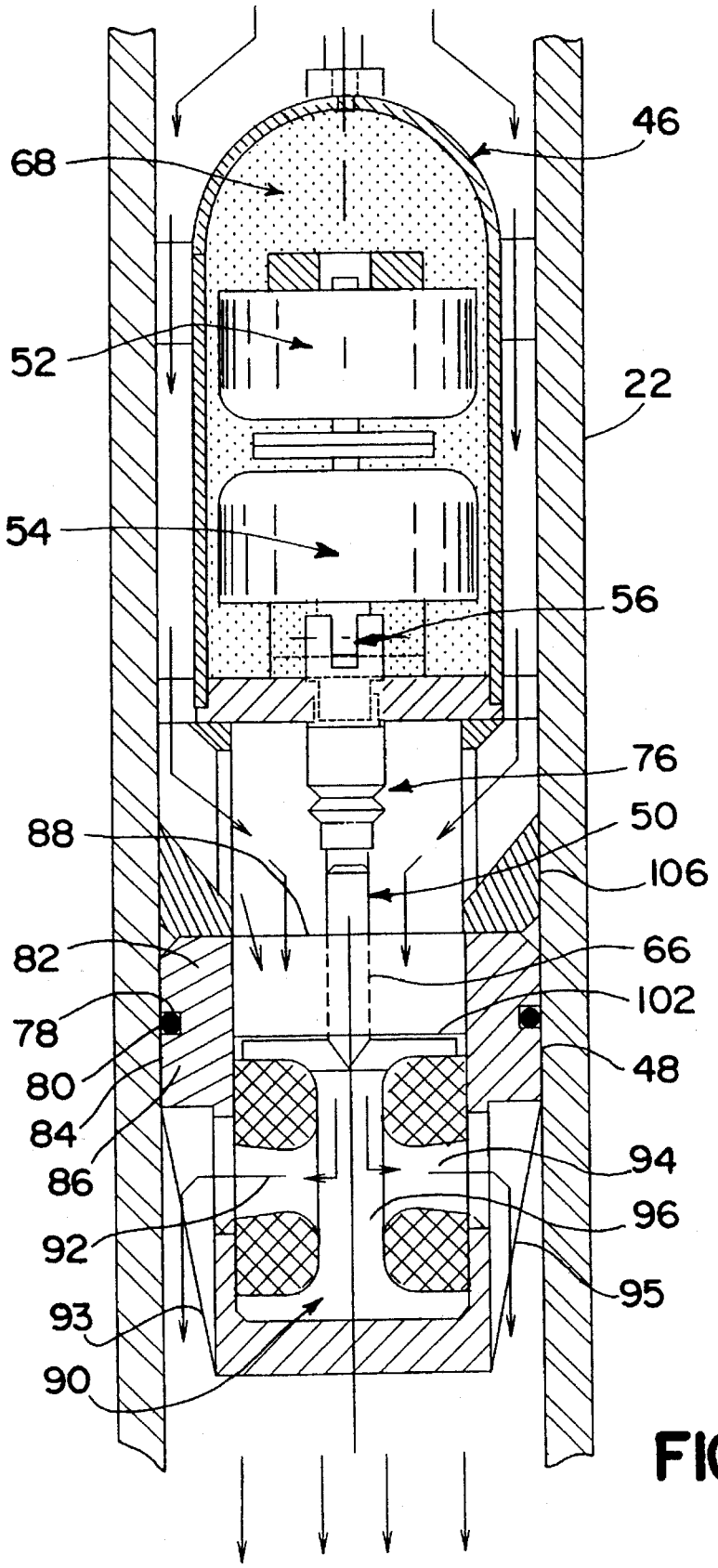
FIG. 3 is a side view in section of the vortex chamber mud pulser according to the present invention.

The vortex chamber mud pulser 44, FIGS. 2 and 3, has an actuator module 46 and a valve module 48. The actuator module is smaller in diameter than the drill pipe, allowing drilling mud to flow between the module and the pipe. The actuator module converts electrical impulses received from the signal processing package into movement of a control rod 50 extending into the valve module. A pair of coaxial opposed solenoids 52 and 54 are housed in the actuator module. The plungers of the two solenoids (not shown) are connected to a linkage arm 56 pivotably fixed on one end to the actuator module housing 58 by a first pin 60 and pivotably connected on the opposite end by a second pin 62 to the rigid control rod 50 extending through a passage 66 in the housing 84 of valve module 48. Energization of the first solenoid urges linkage 56 and control rod 50 a short distance (on the order of 0.20 inches) toward the valve module 48 into an extended position; alternate energization of the second solenoid returns the linkage and rod toward the actuator module 46 into a retracted position. The actuator module 46 is filled with hydraulic fluid 68 surrounding the solenoids. A diaphragm assembly 70 is attached to the external surface of the actuator module housing and communicates with the hydraulic fluid 68 through an orifice 72. A pressure compensation diaphragm 74 expandably seals the fluid in the actuator module, allowing pressure to be equalized across the walls of the housing and compensating for changes in the internal volume of the actuator module due to movement of the plungers, linkage and control rod, expansion from solenoid heating and changes in ambient pressure. A flexible rubber bellows 76 sealingly surrounds the control rod between the actuator module and the valve module. Alternative configurations and assemblies, for instance, piezo-electric stacks, bi-morph materials and state changing fluids, may be used to translate the electrical impulses from the signal processor into mechanical movement of the control arm.

The valve module 48 is sized to fit tightly in the drill pipe and has a circumferential groove 78 machined into the outer surface to seat an O-ring 80 used to provide a seal between the upper inlet portion 82 of the valve module housing 84 and the lower outlet portion 86. An inlet duct 88 having an axis along the axis of the drill pipe 22 is located on the upper portion of the valve module and communicates with the radial wall of an annular chamber 90. Annular chamber 90 has an axis of revolution lying normal to the axis of the drill pipe 22. Two outlet ducts 92 and 94 are coaxial with the annular axis of revolution and communicate with the vortex chamber through an open cylindrical chamber 96, coaxial with outlet ducts and extending radially to the annular vortex chamber. The axial outlet ducts 92 and 94 can be machined to an efficient nozzle shape or to threadingly receive commercially available drill bit nozzles.

The control rod 50 linking the actuator module 46 to the valve module 48 extends through passage 66 into the annular chamber 90 in a direction parallel to the axis of the drill pipe. Passage 66 and control rod 50 are offset from but adjacent the radial inlet duct 88, perpendicular to the axis of revolution of annular chamber 90 and centered thereto. A perpendicular tab 102 is attached to the free end of control rod 50 and extends in each direction a distance less than half the width of annular chamber 90 forming a "T" junction with the control rod. A groove or slot 104 is machined into the interior wall of the annular chamber 90 and sized to accept tab 102 in a recessed position flush with the contour of the chamber wall when control rod 50 is in the retracted position. When control rod 50 is in the extended position, tab 102 is displaced into the vortex chamber by a distance corresponding to the distance control rod 50 is urged by linkage 56.

Figure 4:
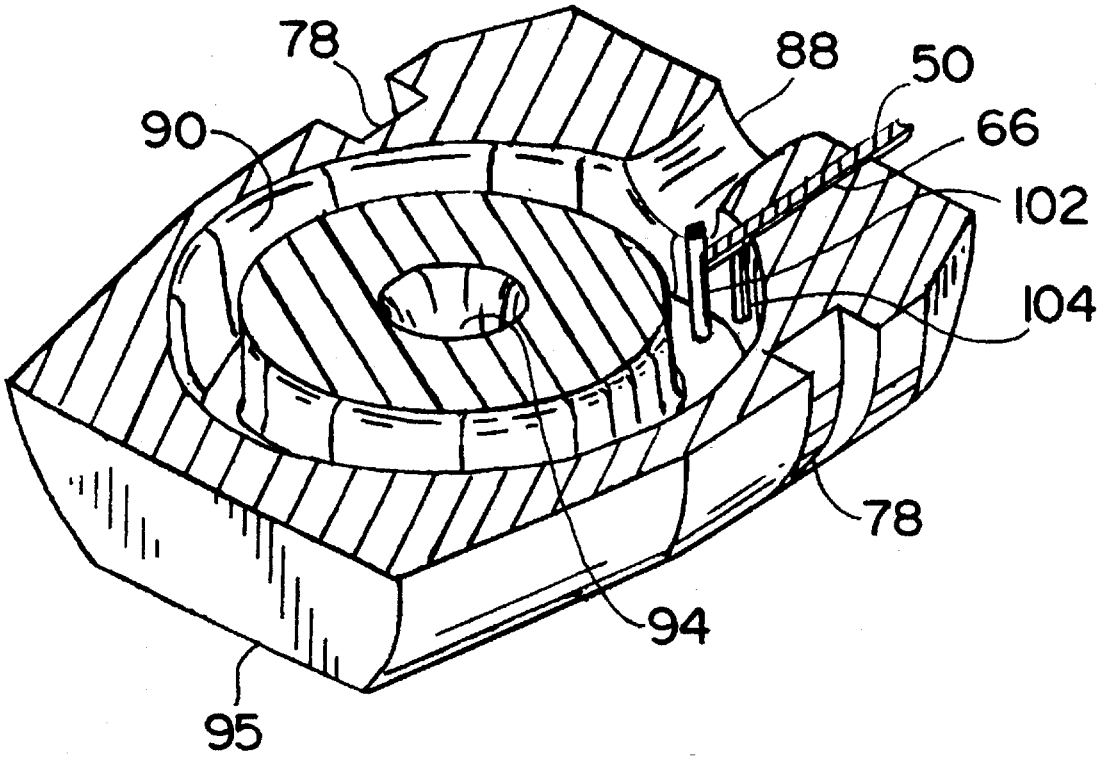
FIG. 4 is a perspective cross-section view of the vortex chamber of the present invention taken along the vortex chamber plane of symmetry.

The composite geometry of the annular chamber 90, the axial outlet ducts 92 and 94, the cylindrical chamber 96, passage 66 and slot 104 form a vortex chamber 105, shown in FIG. 4, having geometric symmetry on either side of the plane passing through the axes of inlet duct 88 and outlet ducts 92 and 94.

The valve module housing 84 is tapered on opposite sides at 93 and 95 in the vicinity of the two axial outlet ducts 92 and 94, respectively, to permit free flow between the housing and the drill pipe of drilling mud passing through the vortex chamber 105. A downwardly converging flow guide 106 can be used to channel the annular flow of drilling mud past the actuator module 46 into inlet duct 88 of the valve module 48.

The symmetry of the vortex chamber 105 greatly simplifies fabrication of the valve module. Each identical half of the chamber, as shown in FIG. 4, is machined from a piece of solid stock, the two halves are assembled together into a unit, and the unit is turned on a lathe to achieve the required diameter and to cut O-ring groove 78. Tapered sections 93 and 95 are then milled into the sides of the unit. The two halves are disassembled, the retractable control rod 50 and tab 102 assembly is positioned and the halves are reassembled to each other by bolts, brazing or other means. These simple fabrication techniques are generally well suited to modern numerical control machine shop practice.

In use, the vortex chamber mud pulser 44 is positioned in the drill pipe 22 near the instrumentation 39, signal processor 40 and power supply 42. Electrical impulses are fed from the signal processor to the actuator module 46 in sequences containing data encoded into binary form and applied alternately to a first and second coaxial solenoid 52 and 54 to magnetically move the plunger and, through linkage 56, to selectively extend and retract a control rod 50 alternatively toward and away from the valve module 48. The mass and travel distance of the control rod and tab are small; consequently less actuator power is required and system response time is faster than in typical mechanical systems. Moreover, the simplicity of movement and minimal inertia of the control rod and tab assures a rugged shock-resistant device well suited to the down-hole environment.

Figure 6:
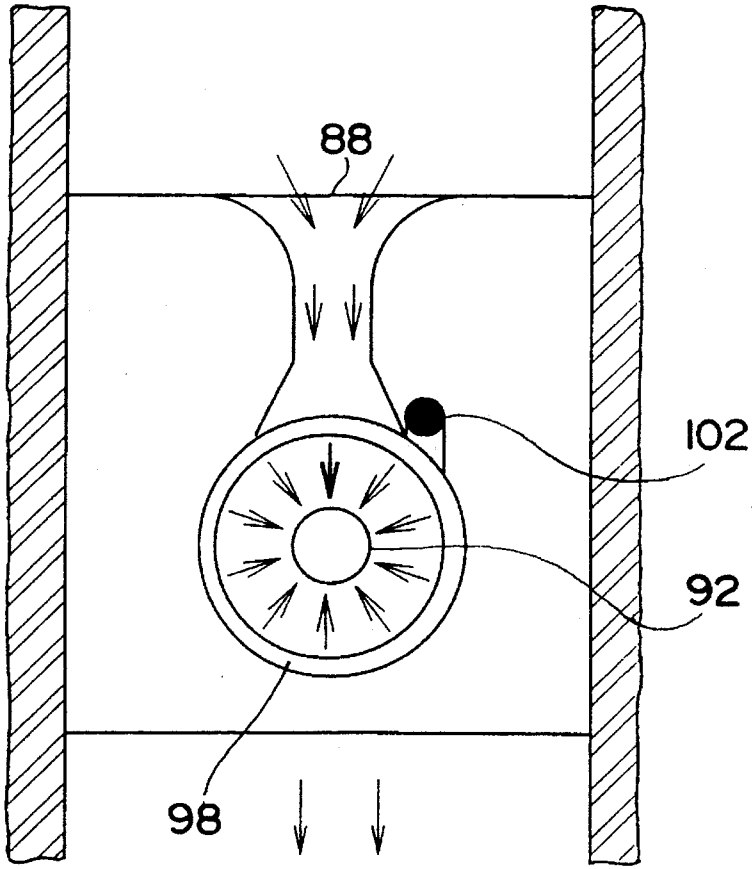
FIG. 6 is a simplified front cross-section diagram illustrating fluid flow.
Figure 5:
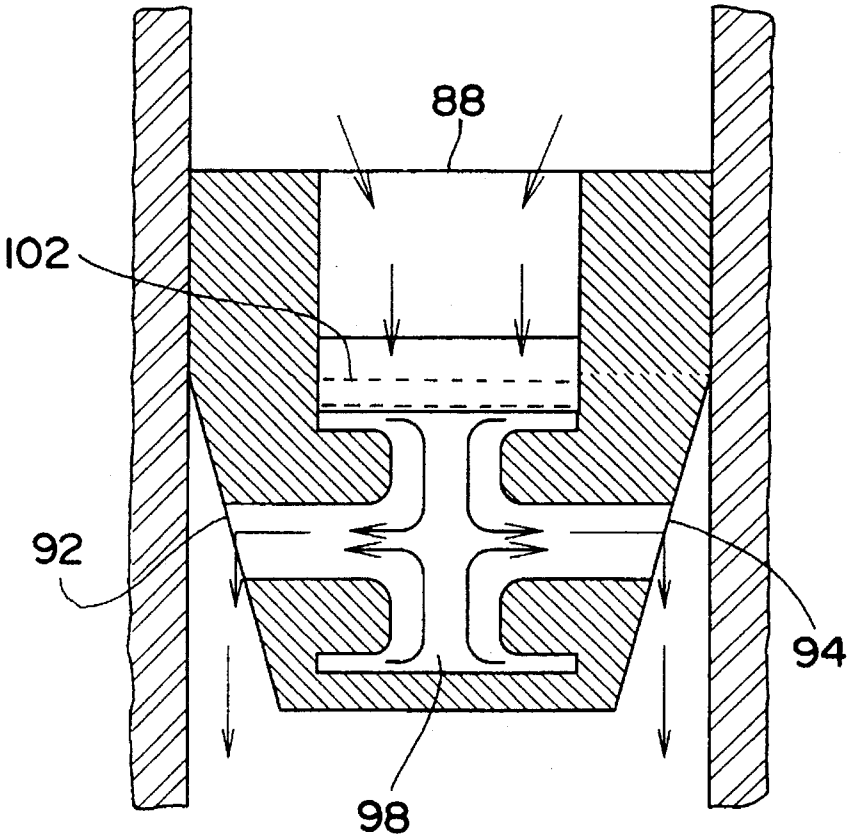
FIG. 5 is a simplified side cross-section diagram illustrating fluid flow through the vortex chamber of the invention with its actuator tab withdrawn into a recess.
Figure 8:
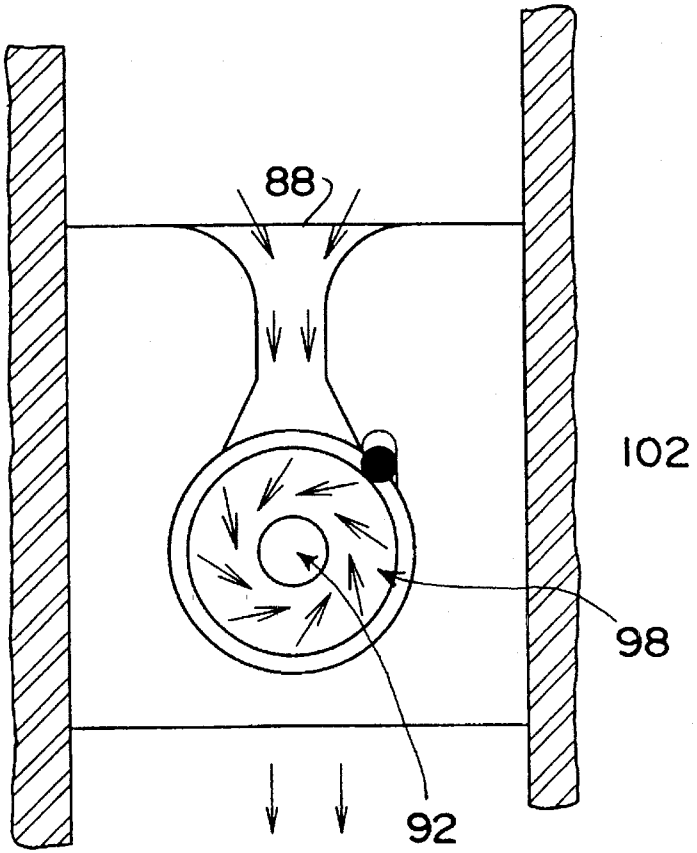
FIG. 8 is a simplified front cross-section diagram illustrating fluid flow as in FIG. 7.
Figure 7:
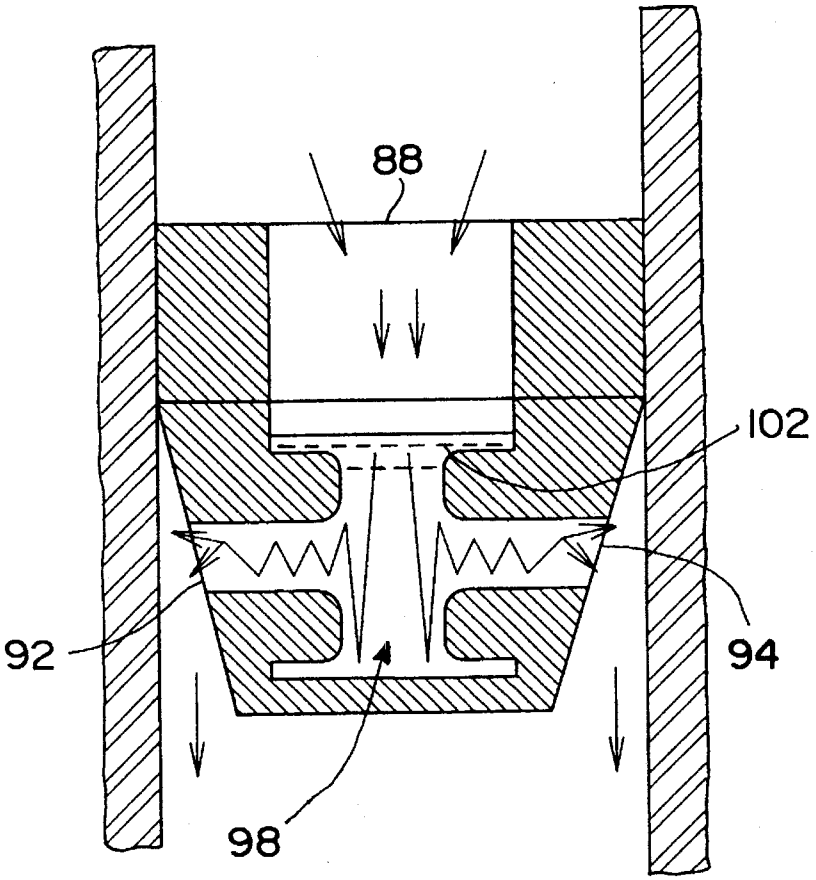
FIG. 7 is a simplified side cross-section diagram illustrating fluid flow through the vortex chamber with the tab extended into the chamber.

Drilling mud propelled down the drill pipe by pump 36 passes around the actuator module and into inlet duct 88 in the valve module 48. Passage of mud around the valve module is prevented by O-ring 80 sealingly compressed between the valve module and the drill pipe. The mud flows through the inlet into the vortex chamber 105. When the control rod 50 is in the retracted position, tab 102 is recessed in groove 104 and does not interfere with the flow of the drilling mud. Undisturbed flow encircles the vortex chamber 105 in a relatively symmetric pattern resulting in radial flow into the axial outlet ducts 92 and 94 as shown in FIGS. 5 and 6, with a plane of essentially zero flow formed midway between the two outlet ducts along the vortex chamber plane of symmetry. In prior art single outlet devices this plane is formed by a back plate and is subjected to high pressure and wear. Here the pressure is equalized as the fluid is free to flow symmetrically in both directions. When control rod 50 is extended in response to an electrical impulse sent to the actuator module 48 from the signal processor 40, tab 102 is projected into the vortex chamber 105 and the chamber ceases to have symmetry about the axis of the radial inlet duct 88. The obstruction produced by tab 102 initiates a vortical flow pattern, shown by the arrows in FIGS. 7 and 8, following the chamber walls away from the disturbance and producing a "free" vortex. In a "free" vortex the angular momentum of the fluid is conserved and the angular velocity of the fluid increases as the flow swirls toward the centrally located outlet ducts 92 and 94. The increasing velocity produces a large pressure gradient between the slower moving and higher pressure flow near the chamber walls and the faster moving and lower pressure flow approaching the outlets. The magnitude of the throttling effect of the gradient is determined by the geometry of the chamber. The vortex increases the tangential velocity of the flow, reduces the static pressure normally driving the fluid through the outlets and produces a rapid reduction in flow rate, known as a "water hammer". The sudden flow restriction produces a pressure pulse propagating through the fluid at the speed of sound. A similar pulse is initiated by the withdrawal of tab 102 from the chamber as the flow returns to an unperturbed radial flow pattern with an attendant rapid increase in flow rate. Pressure pulses thus generated travel up the drilling mud and are sensed by a pressure transducer 45 in feed line 32 on the surface where the data encoded in the sequences or patterns of pressure pulses are interpreted.

In view of the foregoing, it is apparent that the present invention makes available a mud pulser capable of viably telemetering down-hole sensor signals to operators located at the surface. The ability to produce a high signal rate from a rugged, reliable and inexpensive pulser has not been heretofore possible in the prior art.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A vortex chamber mud pulser for selectively producing pressure pulses in a flowing fluid comprising:

an annular vortex chamber having a radial inlet duct for receiving said fluid and a pair of opposed axially aligned outlet ducts for discharging said fluid, whereby the undisturbed flow of said fluid from said inlet duct takes a generally radial path into said opposed outlet ducts;

a tab selectively extendable and retractable from an interior recess in said vortex chamber for altering said flow from a generally radial path to a vortical path; and means for selectively extending and retracting said tab in response to electrical impulses.

2. The vortex chamber mud pulser according to claim 1 wherein said annular vortex chamber has a plane of symmetry passing through the axes of said inlet duct and said outlet ducts.

3. The vortex chamber mud pulser according to claim 2 wherein said tab is centrally located in said annular vortex chamber to disturb fluid flow equally on each side of said plane of symmetry and to produce a plane of zero flow midway between said outlet ducts.

4. The vortex chamber mud pulser according to claim 3 wherein said tab fits into a recess in said chamber in the retracted position to smoothly conform to the chamber surface and is selectively extended into said chamber to disturb said fluid flow.

5. The vortex chamber mud pulser according to claim 1 wherein said outlets have a flow-directing nozzle shape.

6. The vortex chamber mud pulser according to claim 1 wherein said outlet ducts threadedly receive replaceable flow directing nozzle inserts.

7. The vortex chamber mud pulser according to claim 1 wherein said extending and retracting means comprise at least one solenoid mechanism.

8. The vortex chamber mud pulser according to claim 1 wherein said extending and retracting means are housed in a first module and said annular vortex chamber is housed in a second module, said extending and contracting means communicating with said tab via a rigid control arm linking said tab to said extending and contracting means.

9. The vortex chamber mud pulser of claim 8 wherein said means for selectively extending and retracting said tab in response to electrical impulses comprises a solenoid mechanism.

10. The vortex chamber fluid pulser of claim 8 wherein said vortex chamber fluid pulser is sized to fit within the drill pipe of a drill string.

11. The vortex chamber mud pulser of claim 1 in combination with a drill string having fluid flowing therethrough located down-hole during the drilling of a bore hole wherein said pressure pulses are used to convey encoded information to pressure-sensing transducers located on the surface.

* * * * *